US011098427B2

(12) United States Patent
Lee et al.

(10) Patent No.: US 11,098,427 B2
(45) Date of Patent: Aug. 24, 2021

(54) LAUNDRY PROCESSING DEVICE AND METHOD FOR CONTROLLING SAME

(71) Applicant: LG ELECTRONICS INC., Seoul (KR)

(72) Inventors: Woonghyun Lee, Seoul (KR); Jain Koo, Seoul (KR); Suncheol Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 320 days.

(21) Appl. No.: 16/070,720

(22) PCT Filed: Jan. 18, 2017

(86) PCT No.: PCT/KR2017/000599
§ 371 (c)(1),
(2) Date: Jul. 17, 2018

(87) PCT Pub. No.: WO2017/126881
PCT Pub. Date: Jul. 27, 2017

(65) Prior Publication Data

US 2019/0024282 A1 Jan. 24, 2019

(30) Foreign Application Priority Data

Jan. 18, 2016 (KR) ..... 10-2016-0005741

(51) Int. Cl.
*D06F 31/00* (2006.01)
*D06F 33/00* (2020.01)
(Continued)

(52) U.S. Cl.
CPC ..... *D06F 31/00* (2013.01); *D06F 33/00* (2013.01); *D06F 37/10* (2013.01); *D06F 37/28* (2013.01);
(Continued)

(58) Field of Classification Search
None
See application file for complete search history.

(56) References Cited

U.S. PATENT DOCUMENTS

2004/0006831 A1* 1/2004 Kim ..... D06F 13/08 8/159
2008/0022465 A1* 1/2008 Jun ..... D06F 33/00 8/158
(Continued)

FOREIGN PATENT DOCUMENTS

KR 10-1996-0014501 5/1996
KR 10-2010-0094953 8/2010
(Continued)

OTHER PUBLICATIONS

International Search Report (with English Translation) dated May 10, 2017 issued in Application No. PCT/KR2017/000599.

*Primary Examiner* — Cristi J Tate-Sims
(74) *Attorney, Agent, or Firm* — Ked & Associates LLP

(57) ABSTRACT

The laundry processing device according to the present invention comprises: a first washing unit for doing laundry; and a second washing unit having a washing space independent from the first washing unit and provided with a tub of a smaller capacity than the first washing unit, wherein the first washing unit comprises: a first display unit; a first laundry amount detecting unit for measuring the amount of laundry in the first washing unit; and a first control unit for displaying, on the first display unit, a guide message recommending use of the second washing unit if the amount of laundry measured by the first laundry amount detecting unit is less than a first set value. When the amount of laundry is relatively small, the user is induced to use the second washing unit, thereby reducing power consumption.

20 Claims, 5 Drawing Sheets

(51) Int. Cl.

| | |
|---|---|
| ***D06F 37/42*** | (2006.01) |
| ***D06F 39/14*** | (2006.01) |
| ***D06F 37/10*** | (2006.01) |
| ***D06F 37/28*** | (2006.01) |
| *D06F 34/18* | (2020.01) |
| *D06F 34/28* | (2020.01) |

(52) U.S. Cl.
CPC ..... *D06F 37/42* (2013.01); *D06F 39/14* (2013.01); *D06F 34/18* (2020.02); *D06F 34/28* (2020.02); *D06F 2202/10* (2013.01); *D06F 2220/00* (2013.01)

(56) References Cited

U.S. PATENT DOCUMENTS

| | | | | |
|---|---|---|---|---|
| 2009/0145175 | A1* | 6/2009 | Kim | D06F 39/125 68/27 |
| 2013/0042416 | A1 | 2/2013 | Balinski et al. | |
| 2013/0086520 | A1* | 4/2013 | Beaudet | D06F 93/00 715/810 |
| 2015/0047219 | A1* | 2/2015 | Lee | D06F 34/18 34/282 |
| 2017/0191204 | A1 | 7/2017 | Shin et al. | |

FOREIGN PATENT DOCUMENTS

| | | |
|---|---|---|
| KR | 2016-0004533 | 1/2016 |
| WO | WO 2011-149319 | 12/2011 |

* cited by examiner

LAUNDRY PROCESSING DEVICE AND METHOD FOR CONTROLLING SAME

CROSS-REFERENCE TO RELATED PATENT APPLICATIONS

This application is a U.S. National Stage Application under 35 U.S.C. § 371 of PCT Application No. PCT/KR2017/000599, filed Jan. 18, 2017, which claims priority to Korean Patent Application No. 10-2016-0005741, filed Jan. 18, 2016, whose entire disclosures are hereby incorporated by reference.

TECHNICAL FIELD

The present invention relates to a laundry processing device having a plurality of washing units, and more particularly, to a laundry processing device for guiding a washing unit into which laundry is to be put, and a method for controlling the same.

BACKGROUND ART

Generally, a laundry processing device is an apparatus that processes laundry through various operations such as washing, spin-dry and/or drying. Such a laundry processing device includes a laundry processing device that washes laundry such as clothing or bedding by using the emulsifying action of the detergent, the water current action caused by the rotation of the washing tub or the laundry blade, and a mechanical force applied by the laundry blade, a dryer that applies a hot air or a cold air to dry the laundry, and a refresher that removes the wrinkles of the clothes by applying steam. In addition, a washer-drier provides a combination of various functions.

The amount of power consumed during washing is changed according to the capacity of the laundry processing device. For example, when the same amount of laundry is inputted to be washed by a small-capacity laundry processing device and a large-capacity laundry processing device respectively, the small-capacity laundry processing device may consume less power in comparison with a relatively large-capacity laundry processing device.

Recently, in order to save the power consumption of the laundry processing device, in the case of a small amount of laundry, a technology for inducing a small amount of laundry to be performed through the small-capacity laundry processing device has been studied.

DISCLOSURE

Technical Problem

It is an object of the present invention to provide a laundry processing device including a plurality of washing units that have a different capacity and perform washing independently of each other, and a laundry processing device capable of guiding a washing unit of washing units which is advantageous in terms of power consumption and washing performance depending on the amount of laundry, and a method for controlling the same.

Technical Solution

In an aspect, there is provided a laundry processing device including: a first washing unit for performing washing; and a second washing unit having a washing space independent from the first washing unit and provided with a tub of a smaller capacity than the first washing unit, wherein the first washing unit includes: a first display unit; a first laundry amount detecting unit for measuring an amount of laundry in the first washing unit; and a first control unit for displaying, on the first display unit, a guide message recommending use of the second washing unit, if the amount of laundry measured by the first laundry amount detecting unit is equal to or less than a first set value.

In another aspect, there is provided a method for controlling a laundry processing device comprising a first washing unit and a second washing unit that have a washing space independently of each other, the method including: an input step of receiving an input of a washing start command; a measuring step of measuring an amount of laundry in the first washing unit, in response to the washing start command; a comparison step of comparing the measured laundry amount with a first set value; and a guiding step of displaying a guide message recommending use of the second washing unit having a tub of a smaller capacity than the first washing unit on a first display unit provided in the first washing unit, if the amount of laundry is equal to or less than the first set value.

Advantageous Effects

According to a laundry processing device and a method for controlling the same of the present invention, the laundry processing device, including a plurality of washing units that have different capacities and perform washing independently of each other, capable of saving power consumption by guiding a user to use a small-capacity washing unit when a small amount of laundry is inputted to a large-capacity washing unit, thereby reducing power consumption.

Further, when a large amount of laundry is put into a small-capacity washing unit, a large-capacity washing unit is guided to be used to prevent washing from being incompletely performed.

MODE FOR INVENTION

Hereinafter, preferred embodiments of the present invention will be described with standard to the accompanying drawings. In describing the present embodiment, the same designations and the same standard numerals are used for the same components, and further description thereof will be omitted.

Figure 1:
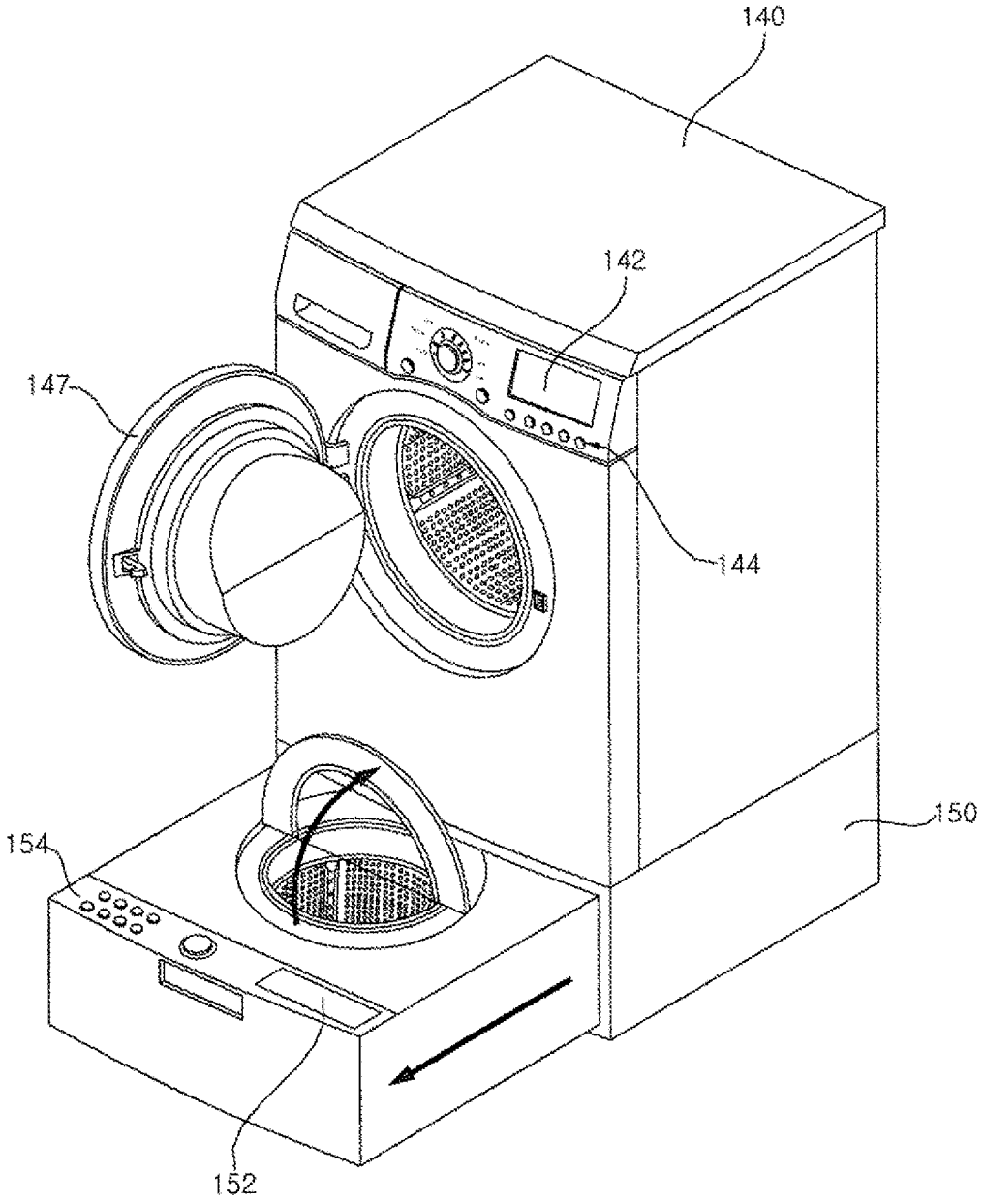
FIG. 1 is a diagram illustrating a shape of a laundry processing device according to an embodiment of the present invention.

FIG. 1 is a diagram illustrating a shape of a laundry processing device 100 according to an embodiment of the present invention.

Referring to FIG. 1, the laundry processing device 100 includes a first washing unit 140 and a second washing unit 150.

The first washing unit 140 and the second washing unit have a separate tub respectively, and perform washing independently.

Specifically, the second washing unit 150 has a washing space independent of the first washing unit 140, and is provided with a tub having a capacity smaller than a tub of the first washing unit 140. That is, since the capacity of the tub of the second washing unit 150 is smaller than the capacity of the tub of the first washing unit 140, when the same amount of laundry is washed, the power consumed by the second washing unit 150 is smaller than the power consumed by the first washing unit 140.

The first washing unit 140 and the second washing unit 150 are provided with separate input units 144 and 154 and display units 142 and 152 respectively, so that a command can be input independently of each other, and an operation corresponding to the inputted command can be performed.

The first washing unit 140 and the second washing unit 150 may be a detachable type so that the first washing unit 140 and the second washing unit 150 can be integrally coupled to each other or separated from each other, or may be an integral type which cannot be combined or separated.

The first washing unit 140 and the second washing unit 150 may be disposed vertically. As shown in the drawing, the first washing unit 140 may be disposed in an upper end of the second washing unit 150.

The first washing unit 140 may be a front load type washing machine provided with a door installed in the front side and the second washing unit 150 may be a top load type washing machine having a door installed in the upper end.

The second washing unit 150 is configured to be slidably opened and closed in the front and rear direction like a drawer. When the second washing unit 150 is pulled to the front, the upper end of the second washing unit 150 is exposed. The second input unit 154, the second display unit 152, and the second door 157 are disposed in the upper end of the second washing unit 150.

As shown in the following drawing, it is illustrated that the first and second washing units 140 and 150 are disposed vertically, but the present invention is not limited thereto and the first washing unit 140 and the second washing unit 150 may be disposed laterally.

Figure 2:
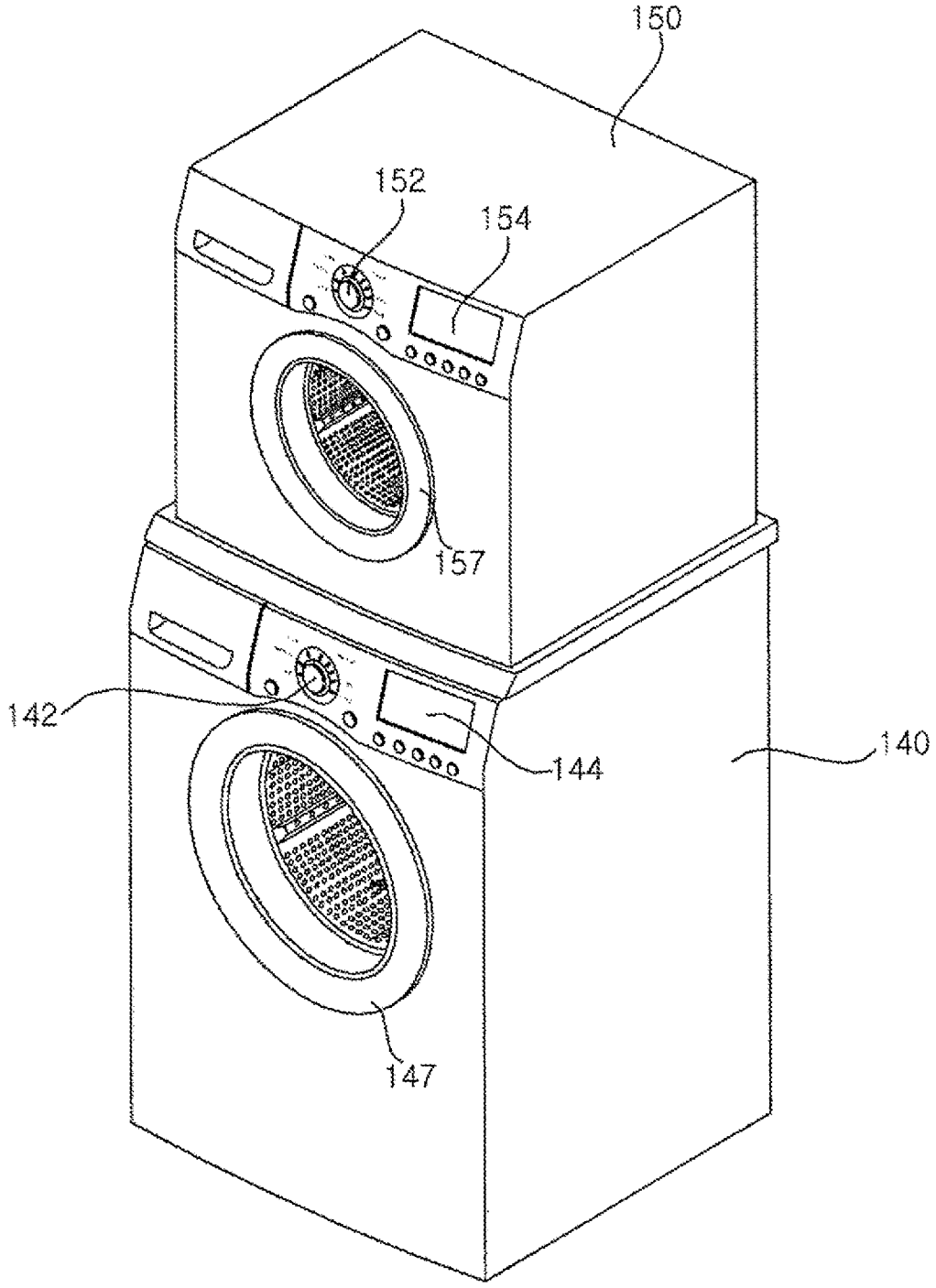
FIG. 2 is a diagram illustrating a shape of a laundry processing device according to another embodiment of the present invention.

FIG. 2 is a diagram illustrating a shape of a laundry processing device according to another embodiment of the present invention.

Referring to FIG. 2, according to another embodiment of the laundry processing device 100, the first washing unit 140 and the second washing unit 150 may be implemented in the form of two front load washing machine. The second washing unit 150 is disposed in the upper end of the first washing unit 140. The first washing unit 140 includes a first input unit 144, a first display unit 142, and a first door 147. The second washing unit 150 includes a second input unit 154, a second display unit 152, and a second door 157.

In addition, according to another embodiment of the laundry processing device, both the first washing unit 140 and the second washing unit 150 may be in the form of a top load washing machine. The disposition of each washing unit, and the shape of the first washing unit 140 and the second washing unit 150 is not limited.

Figure 3:
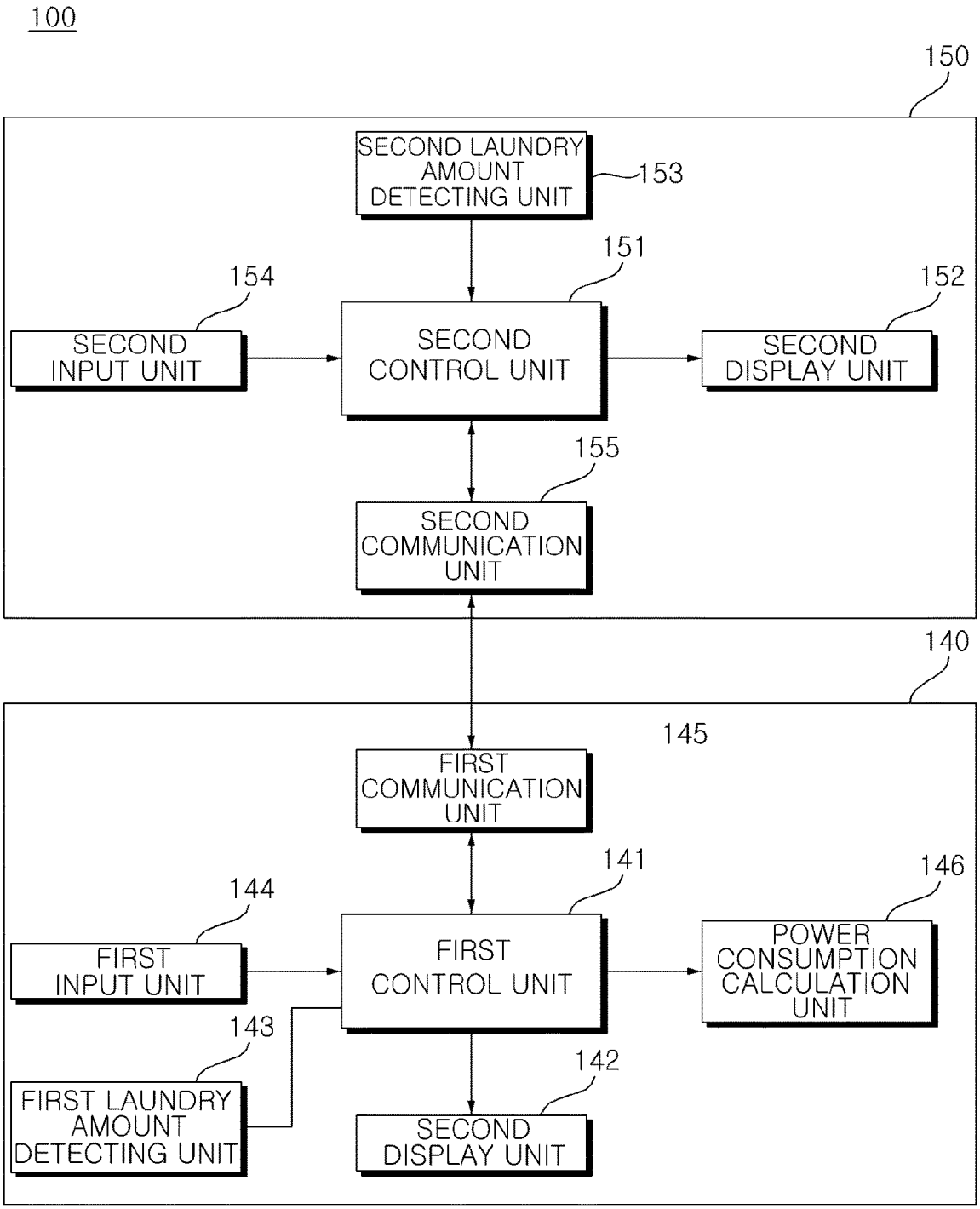
FIG. 3 is a block diagram illustrating a configuration of a laundry processing device according to an embodiment of the present invention.

FIG. 3 is a block diagram illustrating a configuration of a laundry processing device according to an embodiment of the present invention.

The first washing unit 140 includes a first display unit 142, a first laundry amount detecting unit 143, and a first control unit 141. The first washing unit 140 may further include a first communication unit 145 and a power consumption calculation unit 146. In addition, the first washing unit 140 may further include a wireless communication unit (not shown) for performing wireless communication with a preset mobile terminal.

The second washing unit 150 includes a second control unit 151, a second display unit 152, a second laundry amount detecting unit 153, a second input unit 154, and a second communication unit 155.

The operation performed by the second control unit 151, the second display unit 152, the second laundry amount detecting unit 153, and the second input unit 154 with respect to the second washing unit 150 is the same as the operation performed by the first control unit 141, the first display unit 142, the first laundry amount detecting unit 143, and the first input unit 144, and the first washing unit 140 and the second communication unit 155 perform mutual communication. The first communication unit and the second communication unit can perform communication by wire or wireless, which are not limited. Therefore, the description of the general operation of the components included in the second washing unit will be omitted in the following.

In addition, the first washing unit 140 and the second washing unit 150 may include respectively at least one detection means for detecting temperature, pressure, voltage, current, water level, number of revolutions, and the like. The data detected through the detection means is applied to the first control unit 141 or the second control unit 151. For example, the water level can be measured through a water level detection means during the water supply or drainage of the first washing unit 140, the temperature of supplied water can be measured through a temperature detection means, and the rotation speed of a tub or drum may be measured through various detection means.

In addition, the first washing unit 140 and the second washing unit 150 may further include respectively a memory for storing data, a water supply unit or a drainage unit for controlling water supply/drainage, and the like. A description thereof will be omitted.

The first control unit 141 controls the overall operation of the first washing unit 140. The first control unit 141 controls the first washing unit 140 to perform washing according to a set washing course and an operation setting. A detailed description of the first control unit 141 will be described later.

The first display unit 142 displays a command input by the first input unit 144, a guide message of inducing the use of the second washing unit, information on a running operation of the laundry processing device 100, an error relating to malfunction when the malfunction occurs, and information upon completion of the operation, in response to a control signal of the first control unit 141. For example, the first display unit 142 displays the progress of operation such as main washing, rinsing, and dry-spin operation by using at least one of letter, number, special character, emoticon, and image.

The first display unit 142 is implemented by a display means such as LCD, LED, and the like. The first display unit 142 may be a touch screen capable of inputting various types of touches. In this case, the touch screen may be operated as a first input unit 144 and a first display unit 142.

The first input unit 144 is operated by a user to transmit a certain signal or data to the first control unit 141. The first input unit 144 includes at least one input means and is configured by a button, a dome switch, a touch pad (resistive/static), a jog wheel, a jog switch, a finger mouse, a rotary switch, a jog dial, and the like, and any device capable of generating certain input data by an operation such as pressing, rotating, pressure, contact, or the like can be applied. The first input unit 144 can transmit a signal different from a signal which is generated at the time of a single key input operation to the first control unit 141, according to continuous key inputs of two or more times or continuous key inputs for a set time or more, and thus, enables the laundry processing device 100 to perform a specific operation.

The first input unit 144 receives a command for the first washing unit 140. Specifically, the first input unit 144 includes a washing start key to which a washing start command is inputted, and may further include a selection key for selecting a washing course and performing an operation setting, and a washing unit selection key for selecting a washing unit to perform washing.

Even if the washing unit selection key is not provided in some cases, the function of the washing unit selection key can be performed through a general selection key or a combination of at least two selection keys.

When selecting the use of the first washing unit 140 or the use of the second washing unit 150 in response to a guide message recommending the use of the second washing unit 150, the first input unit 144 may use a selection key for performing the above-described washing course selection and operation setting, or use a separately provided washing unit selection key.

The first laundry amount detecting unit 143 measures the amount of laundry existing in the tub of the first washing unit 140 under the control of the first control unit 141.

For example, the first laundry amount detecting unit 143 may include a hall sensor, an encoder, and the like. The first laundry amount detecting unit 143 periodically detects a current flowing in the motor of the first washing unit 140, and measures the amount of laundry existing in the first washing unit 140 based on the detected current. Specifically, the first laundry amount detecting unit 143 measures the amount of laundry inside the first washing unit 140, by using the current value of the motor during the rotation of the tub from a stop state to a certain rotation angle as the motor of the first washing unit 140 operates.

In addition, the first laundry amount detecting unit 143 may measure the amount of laundry inside the first washing unit 140 by using a weight sensor (not shown) provided separately in the first washing unit 140. When the first laundry amount detecting unit 143 uses the weight sensor, the weight change of the tub of the first washing unit 140 is measured by the weight sensor. The first laundry amount detecting unit 143 measures the amount of laundry inside the first washing unit 140 based on the weight change of the tub of the first washing unit measured by the weight sensor.

The first control unit 141 measures the amount of laundry inside the first washing unit 140 through the first laundry amount detecting unit 143, when the washing start command is inputted through the washing start key provided in the first input unit 144. In some cases, the first input unit 144 may include a key for inputting a separate laundry measurement command, and the first control unit 141 can measure the amount of laundry inside the first washing unit 140 through the first laundry amount detecting unit 143 in response to the laundry measurement command inputted through the key for inputting the laundry measurement command.

The first control unit 141 compares the amount of laundry measured through the first laundry amount detecting unit 143 with a first set value. When the measured amount of the laundry is equal to or less than the first set value, the first control unit 141 generates a guide message for recommending the use of the second washing unit 150, and displays the guide message on the first display unit 142.

The first set value is a standard for determining whether the amount of the laundry put into the first washing unit 140 is a small amount, and can set the standard by using an amount of laundry that can be accommodated in the second washing unit 150. That is, the fact that the amount of laundry measured through the first laundry amount detecting unit 143 is equal to or less than the first set value indicates that a small amount of laundry is put into the first washing unit 140. The first set value can be changed according to the capacity of each tub, and is not limited thereto.

When the first set value is set as the maximum amount of laundry that can be washed by the second washing unit 150, if the washing start key of the first input unit 144 is inputted in a state where the amount of laundry less than the maximum amount is put into the first washing unit 140, the first control unit 141 measures the amount of laundry put into the first washing unit 140 through the first laundry amount detecting unit 143. Since the measured amount of laundry is equal to or less than the first set value, the first control unit 141 enables to display a guide message recommending the use of the second washing unit 150 on the first display unit 142.

The guide message is a message of guiding the laundry contained inside the first washing unit 140 to be washed by using the second washing unit 150 rather than the first washing unit 140. Since the capacity of the tub of the second washing unit 150 is smaller than the capacity of the tub of the first washing unit 140, when washing is performed with respect to a relatively small amount of laundry, the amount of power consumed when washing is performed by using the second washing unit 150 is smaller than the amount of power consumed when the washing is performed by using the first washing unit 140.

In the case of washing laundry that can be accommodated in the second washing unit 150, since the power consumption can be reduced by performing the washing by using the second washing unit 150 rather than the first washing unit 140, the laundry processing device 100 displays the guide message on the first display unit 142 so that the user can recognize the guide message.

When the first display unit 142 includes at least one light emitting element, the guide message can be displayed by lighting a specific light emitting element. In addition, the first control unit 141 may generate a guide message so as to include a specific explanatory text and display the guide message on the first display unit 142. For example, a text indicating that power consumption can be saved by using the second washing unit 150, and a text guiding the estimated power consumption difference between the first washing unit 140 and the second washing unit 150 calculated through the power consumption calculation unit 146, and the next user operation can be displayed. If the first display unit 142 is a touch screen, the first control unit 141 may enable the first display unit 142 to display a selection button corresponding to the guide message.

After the guide message is displayed on the first display unit 142, the first control unit 141 selects a washing unit to be used for washing from among the first washing unit 140 and the second washing unit 150 according to the input of the washing unit selection key provided in the input unit 144. After the guide message is displayed on the first display unit 142, when the washing unit selection key is not input during a set time, or when a first washing unit use command is inputted through the washing unit selection key, the first control unit 141 enables the first washing unit 140 to perform washing. The set time can be arbitrarily set by a user. In addition, after the guide message is displayed on the first display unit 142, when the washing start key provided in the first input unit 144 is inputted, the first control unit 141 determines as the first washing unit use command so that washing can be performed by using the first washing unit 140.

When a second washing unit use command is inputted in response to the guidance message displayed on the first display unit 142, the first control unit 141 transmits information on at least one of the measured laundry amount of the first washing unit 140, and the previously inputted washing course and operation setting to the second washing unit 150, through the first communication unit 145 that communicates with the second communication unit 155 provided in the second washing unit 150.

The second washing unit 150 receives information transmitted from the first communication unit 145 through the second communication unit 155. When the measured information on at least one of the measured laundry amount of the first washing unit 140, and the previously inputted washing course and operation setting of the first communication unit 140 is received through the second communication unit 155, the second control unit 151 sets the washing course of the second washing unit 150 in response to the received information. That is, the second washing unit 150 can receive information on the measured laundry amount from the first washing unit 140 without measuring the laundry amount separately. Even if a separate washing course and operation setting are not input through the second input unit 154, the second washing unit 150 can receive information on the washing course and operation setting inputted through the first input unit 144 and perform corresponding washing course and operation setting of the second washing unit 150.

In addition, when the second washing unit use command is inputted in response to the guidance message, the second control unit 151 sets the washing course of the second washing unit 150 in response to the information received from the first washing unit 140. Thereafter, the user can perform washing operation by using the second washing unit 150 by moving the laundry put into the first washing unit 140 to the second washing unit 150 and inputting the washing start key of the second input unit 154.

The first washing unit 140 may further include a first door 147 provided in an entrance for inputting laundry and a first door sensor (not shown) for detecting the opening of the first door 147.

When the opening of the first door 147 is detected by the first door sensor after the guide message is displayed, the first control unit 141 controls to transmit the information on at least one of the measured laundry amount of the first washing unit 140, and the previously inputted washing course and operation setting to the second washing unit 150 to the second washing unit 150 through the first communication unit 145. The second control unit 151 sets the washing course of the second washing unit 150 in response to the information received from the first washing unit 140.

In this case, after the guide message is displayed, since the opening of the first door 147 is to transfer the laundry, the first control unit determines that the second washing unit use command is inputted when the opening of the first door 147 is detected.

That is, when the user reads the guide message and intends to use the second washing unit 150 instead of the first washing unit 140, the first door 147 should be opened during the process of transferring the laundry from the first washing unit 140 to the second washing unit 150. Therefore, the first control unit 141 can determine that the second washing unit use command is inputted when the first door 147 is just only opened.

The power consumption calculation unit 146 calculates the estimated power consumption of each of the first washing unit 140 and the second washing unit 150 based on the laundry amount measured through the first laundry amount detecting unit 143, and calculates an estimated power consumption difference between the washing unit 140 and the second washing unit 150. Specifically, when the laundry amount put into the first washing unit 140 is measured through the first laundry amount detecting unit 143, the power consumption calculation unit 146 calculates the estimated power consumption when the laundry is washed by using the first washing unit 140 and the estimated power consumption when the laundry is washed by using the second washing unit 150, and calculates an estimated power consumption difference between the first washing unit 140 and the second washing unit 150.

The first control unit 141 enables the first display unit 142 to display an estimated power consumption difference between the first washing unit 140 and the second washing unit 150 calculated by the power consumption calculation unit 146. When the amount of laundry measured through the first laundry amount detecting unit 143 is equal to or less than the first set value, the first control unit 141 enables the first display unit 142 to display the estimated power consumption difference between the first washing unit 140 and the second washing unit 150 calculated by the power consumption calculation unit 146 along with the guide message recommending the use of the second washing unit 150.

When user performs washing for a small amount of laundry by using the first washing unit 140 having a larger capacity than the second washing unit 150, there exist a problem of power consumption. However, when user performs washing for a relatively large amount of laundry by using the second washing unit 150 having a smaller capacity than the first washing unit 140, there exist a problem in that the washing is not smoothly performed. Hereinafter, a case where a large amount of laundry is put into the second washing unit 150 will be described according to another embodiment of the present invention.

If the amount of laundry measured by the second laundry amount detecting unit 153 for measuring the amount of laundry inside the second washing unit 150 is equal to or greater than the second set value, the second washing unit 150 enables the second display unit 152 to display a guide message recommending the use of the first washing unit 140 having a tub of capacity larger than the second washing unit 150.

More specifically, the second input unit 154 provided in the second washing unit 150 includes a washing start key to which a washing start command of the second washing unit 150 is inputted, and further includes a washing unit selection key for inputting a second washing unit use command or a first washing unit use command in response to a guide message recommending the use of the first washing unit 140.

The second control unit 151 controls to measure the amount of laundry inside the second washing unit 150 through the second laundry amount detecting unit 153, when the washing start command is inputted through the washing start key of the second input unit 154. The second laundry amount detecting unit 153 measures the amount of laundry inside the second washing unit 150, and the operation principle thereof is the same as the above described operation principle of the first laundry amount detecting unit 143.

The second control unit 151 enables the second display unit 152 to display a guide message recommending the use of the first washing unit 140 when the amount of laundry measured by the second laundry amount detecting unit 153 is equal to or greater than a second set value. The second set value is a standard value for determining whether the amount of laundry is too large for the second washing unit 150. The fact that the amount of laundry inside the second washing unit 150 is equal to or greater than the second set value means that too large amount of laundry is put into the second washing unit 150. The second control unit 151 displays a guidance message recommending the use of the first washing unit 140 on the second display unit 152 so that the user can use the first washing unit 140.

After the guide message for recommending the use of the first washing unit 140 is displayed on the second display unit 152, when the set time is elapsed, a washing start command is inputted through the washing start key of the second input unit 154, or a second washing unit use command is inputted through the washing unit selection key, the second control unit 151 controls the second washing unit 150 to perform washing. In some cases, the second control unit 151 can output a warning of washing-inability due to overload of laundry through the second display unit.

The second washing unit 150 may further include a second communication unit 155 that communicates with the first washing unit 140. When the first washing unit use command is inputted through the washing unit selection key of the second input unit 154 in response to the guidance message, the second control unit 151 controls to transmit information on at least one of the measured laundry amount of the second washing unit 150, and the previously inputted washing course and operation setting to the first washing unit 140 through the second communication unit 155.

The first washing unit 140 receives the information transmitted by the second communication unit 155 through the first communication unit 145. The first control unit 141 sets the washing course of the first washing unit 140 in response to the information on at least one of the measured laundry amount of the second washing unit 150, and the previously inputted washing course and operation setting received through the first communication unit 145.

The first control unit 141 enables a wireless communication unit (not shown) to transmit the guide message displayed on the first display unit 142 to a preset mobile terminal. The wireless communication unit may transmit the guide message to a preset mobile terminal by using one of Bluetooth, radio frequency identification (RFID), near field communication (NFC), Internet, and mobile communication network. The wireless communication unit may be a means capable of performing wireless communication, and is not limited thereto.

The guide message transmitted to the mobile terminal may further include an input window for selecting whether to use the second washing unit 150 or the first washing unit 140, and an input window for selecting the second washing unit 150 or the first washing unit 140 may be displayed on the screen of the mobile terminal receiving the guide message. The user can select a washing unit which will perform washing from among the second washing unit 150 and the first washing unit 140 through the input window displayed on the screen of the mobile terminal.

Figure 4:
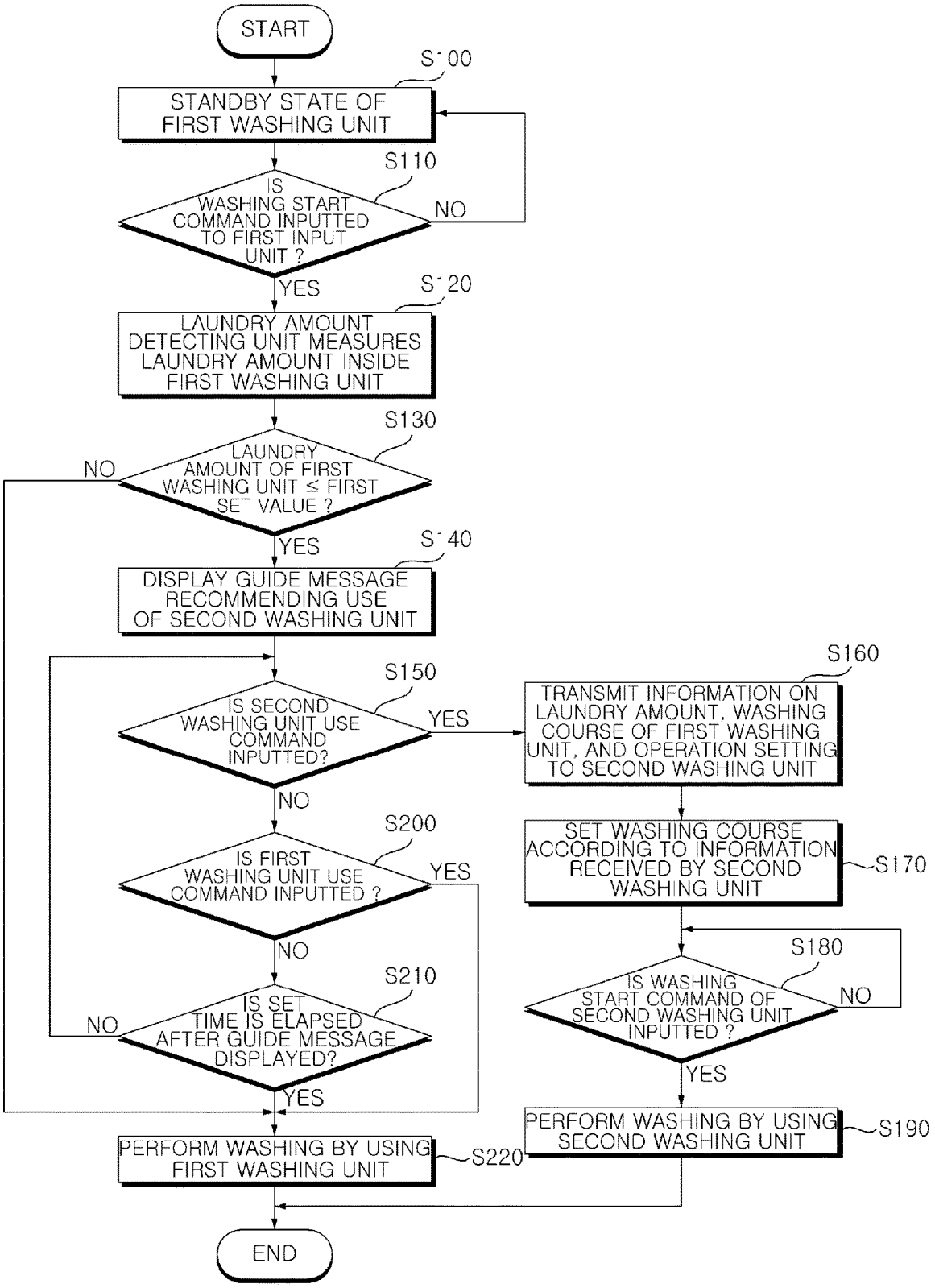
FIG. 4 is a diagram for explaining a control method of a laundry processing device according to an embodiment of the present invention.

FIG. 4 is a diagram for explaining a control method of a laundry processing device according to an embodiment of the present invention.

When the power is turned on, the first washing unit 140 enters a standby state for waiting for a user input (S100). The standby state is a state in which a user command can be input to the first washing unit 140 through the first input unit 144.

The power of the first washing unit 140 and the second washing unit 150 included in the laundry processing device 1000 can be turned on or off independently of each other. The first washing unit 140 and the second washing unit 150 can be turned on or off simultaneously through a power button provided in the first input unit 144 or the second input unit 154. Optionally, the laundry processing device 100 may have a separate simultaneous power button, and the first washing unit 140 and the second washing unit 150 can be simultaneously turned on or off through the simultaneous power button.

When a washing start command is inputted through the washing start key provided in the first input unit 144 of the first washing unit 140 (S110), the first control unit 141 controls the first laundry amount detecting unit 143 to measure the amount of laundry inside the first washing unit 140 (S120).

The first laundry amount detecting unit 143 measures the amount of inputted laundry and inputs the measured laundry amount to the first control unit. For example, the first laundry amount detecting unit 143 can measure the amount of laundry by detecting the current generated when rotating the motor of the first washing unit 140, and can detect the amount of laundry through a separate sensor that measures the amount of laundry. The explained method of detecting the amount of the laundry is just an example, and various methods of detecting the amount of the laundry can be applied.

The first control unit 141 compares the laundry amount measured through the first laundry amount detecting unit 143 with the first set value (S130). If the measured laundry amount is equal to or less than the first set value, the first control unit 141 enables the first display unit 142 to display a guide message recommending the use of the second washing unit 150 (S140).

Since the tub of the second washing unit 150 has a smaller capacity than the tub of the first washing unit 140, when the laundry amount is sufficient to be washed by the second washing unit 150, if the second washing unit 150 is used in place of the first washing unit 140, power consumption is relatively saved. The first control unit 141 enables the first display unit 142 to display also a message that the power consumption can be saved when the second washing unit 150 is used, while displaying the guide message. The laundry processing device 100 according to the present invention induces the user to use the second washing unit 150 through the guide message displayed on the first display unit 142 and the amount of power consumption that can be saved.

The first control unit 141 performs washing by using the first washing unit 140, when the laundry amount measured according to the input of the washing start command exceeds the first set value (S220).

When the second washing unit use command is inputted in response to the guide message (S150), the first control unit 141 transmits the information on the laundry amount measured by the first laundry amount detecting unit 143, the washing course inputted to the first washing unit 140, and the operation setting to the second washing unit 150 through the first communication unit 145 (S160). The second washing unit use command is inputted through the washing unit selection key provided in the first input unit 144. The transmission and reception of information between the first washing unit 140 and the second washing unit 150 are performed by the first communication unit 145 provided in the first washing unit 140 and the second communication unit 155 provided in the second washing unit 150.

In addition, when the user opens the first door 147 provided in the first washing unit 140 to transfer the laundry to the second washing unit 150 according to the guide message, the first control unit 141 can transmit the information on the laundry amount measured by the first laundry amount detecting unit 143, the washing course inputted to the first washing unit 140, and the operation setting to the second washing unit 150 as the first door sensor of the first washing unit 140 detects the opening of the first door 147.

The second washing unit 150 receives the information transmitted from the first washing unit 140 through the second communication unit 155, and the second control unit 151 sets the washing course of the second washing unit 150 according to the received information (S170). The washing course can be implemented by at least one washing operation among washing, rinsing, spin-dry, and drying. The washing course may include, for example, standard washing, quick washing, soak washing, wool washing, blanket washing, boiled washing, cold water washing, baby clothes washing, sterilization washing, and the like.

The second control unit 151 sets the washing course of the second washing unit 150 in consideration of the previously inputted washing course and operation setting, and the laundry amount included in the received information. For example, the amount of laundry measured by the first washing unit may affect the total washing time. If there exists the previously inputted washing course, the washing course may be directly used as a washing course of the second washing unit 150, and the previously inputted operation setting can be reflected in the washing course of the second washing unit 150.

When a washing start command is inputted through the washing start key provided in the second input unit 154 (S180), the second control unit 151 performs washing by using the second washing unit 150 (S190).

When the first control unit 141 enables the first display unit 142 to display a guide message recommending the use of the second washing unit 150 (S140), and if the first washing unit use command is inputted in response to the guide message (S200), the first control unit 141 performs washing by using the first washing unit 140 (S220). If the first washing unit is selected through the washing unit selection key provided in the first input unit 144 or the washing start key is inputted, the first control unit determines that the first washing unit use command is inputted, and operates the first washing unit 140.

When the first control unit 141 displays a guide message recommending the use of the second washing unit 150 on the first display unit 142, and the set time is elapsed in a state in which the first washing unit use command or the second washing unit use command is not inputted (S210), the first control unit 141 determines that the user is unwilling to use the second washing unit 150, and performs washing by using the first washing unit 140 (S220).

Figure 5:
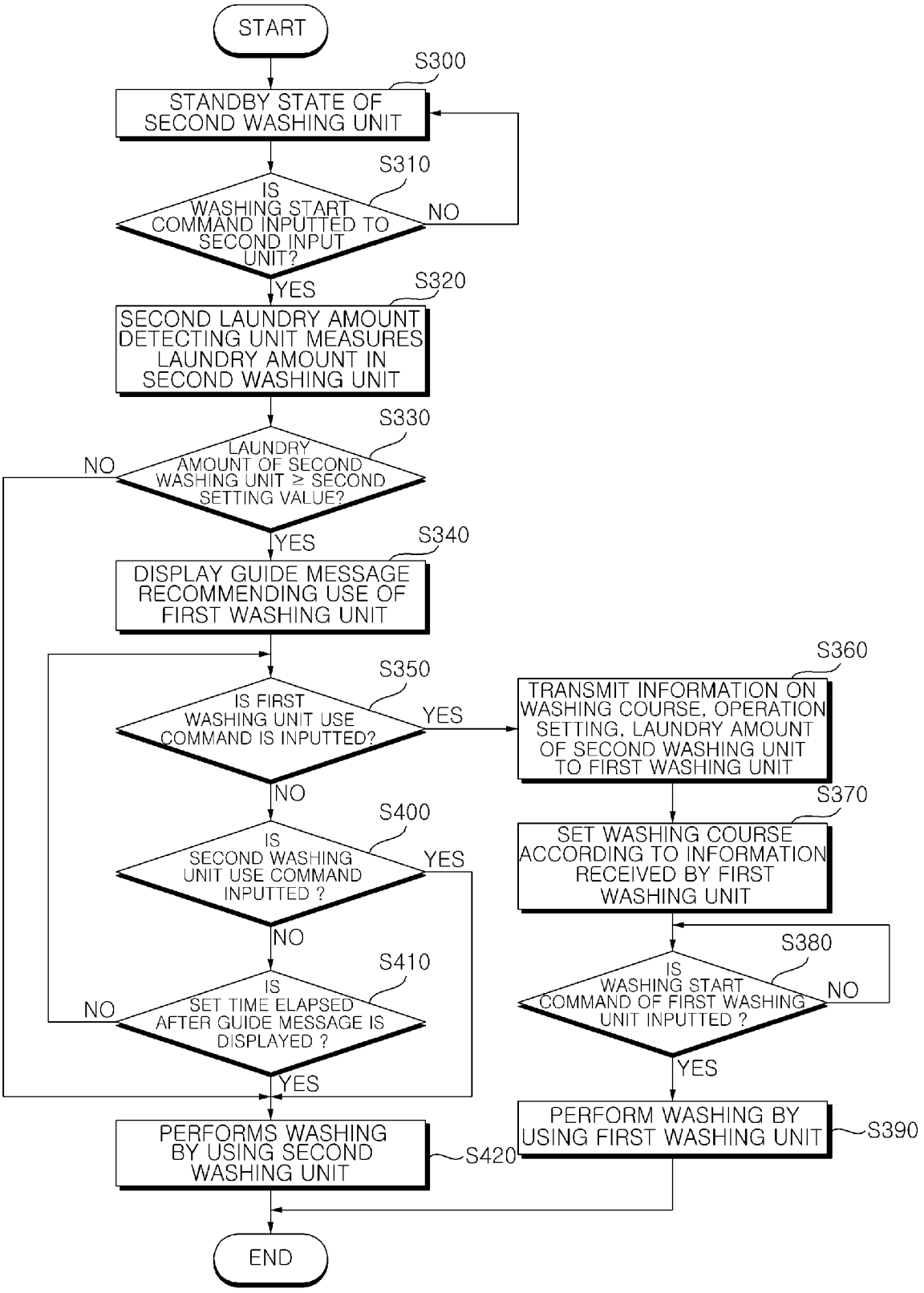
FIG. 5 is a diagram for explaining a control method of a laundry processing device according to another embodiment of the present invention.

FIG. 5 is a diagram for explaining a control method of a laundry processing device according to another embodiment of the present invention.

Since the capacity of the tub of the second washing unit 150 is smaller than that of the tub of the first washing unit 140, if a relatively large amount of laundry is washed by the second washing unit 150, the laundry may not be properly washed. In this case, the washing can be efficiently performed only when washing is performed by using the first washing unit 140.

When the power of the second washing unit 150 is turned on, the second washing unit 150 enters a standby state (S300).

When the second washing unit 150 is in the standby state and a washing start command is inputted through the washing start key of the second input unit 154 (S310), the second control unit 151 controls the second laundry amount detecting unit 153 to measure the amount of laundry put into the tub of the second washing unit (S320).

The second control unit 151 compares the laundry amount measured by the second laundry amount detecting unit with the second setting value, and if the measured laundry amount is equal to or greater than the second set value (S330), enables the second display unit 152 to display a guide message recommending the use of the first washing unit 140 (S340), and performs washing by using the second washing unit when the detected amount of laundry is equal to or less than the second set value (S420).

The second set value is the amount of laundry that cannot be properly washed if the second washing unit 150 is used. When the amount of laundry measured by the second laundry amount detecting unit 153 is equal to or greater than the second set value, washing can be performed efficiently when the first control unit 140 is used. Thus, the second control unit 1510 displays a guide message on the second display unit 152 to guide the user to use the first washing unit 140. The second control unit 151 enables the second display unit 152 to display a guide message indicating that the washing efficiency is improved when the first washing unit 140 is used.

In addition, the second set value may be a value larger than the maximum value of the amount of laundry that the second washing unit 150 can accommodate. In this case, the fact that the amount of the laundry measured by the second laundry amount detecting unit 153 is equal to or greater than the second set value means that the amount of laundry put into the second washing unit 150 is an amount that the second washing unit 150 cannot accommodate. Thus, the second control unit 151 determines that the first washing unit 140 having a large capacity should be used for washing. If the second set value is greater than the maximum value of the amount of laundry that can be accommodated by the second washing unit 150, the second control unit 151 enables the second display unit 152 to display a guide message including a warning text indicating that washing is not possible, or to light a warning lamp indicating that washing is not possible.

When the first washing unit use command is inputted in response to the guide message (S350), the second control unit 151 transmits the information on the laundry amount of the second washing unit 150 measured by the second laundry amount detecting unit 153, the washing course input to the second washing unit 150, and the operation setting to the first washing unit 140 through the second communication unit 155 (S360).

The first washing unit use command can be inputted through a washing unit selection key provided in the second input unit 154, or can be inputted as a second door sensor provided in the second washing unit 150 detects the opening of the second door 157. The transmission and reception of information between the first washing unit 140 and the second washing unit 150 are performed by the first communication unit 145 provided in the first washing unit 140 and the second communication unit 155 provided in the second washing unit 150 by wired or wireless communication.

The first washing unit 140 receives the information transmitted from the second washing unit 150 through the first communication unit 145, and the first control unit 141 sets the washing course of the first washing unit 140 according to the received information (S370).

The washing course of the first washing unit 140 and the second washing unit 150 may be implemented by at least one washing operation of washing, rinsing, spin-dry, and drying, and may be set differently depending on user's setting input, the amount of laundry, the type of laundry, and the like.

When a washing start command is inputted through the washing start key provided in the first input unit 144 (S380), the first control unit 141 performs washing by using the first washing unit 140 (S390).

When a guide message for recommending the use of the first washing unit 140 is displayed on the second display unit 152 (S340), and when a second washing unit use command is inputted in response to the guide message (S400), the second control unit 151 performs washing operation by using the second washing unit 150 (S420). The second washing unit use command may be inputted through a washing unit selection key provided in the second input unit 154, and may be inputted by inputting a washing start key provided in the second input unit 154 in a state in which the guide message is displayed.

When second control unit 151 displays a guide message recommending the use of the first washing unit 140 on the second display unit 152, and the set time is elapsed in a state in which the first washing unit use command or the second washing unit use command is not inputted (S410), the second control unit 151 determines that the user is unwilling to use the first washing unit 140, and performs washing by using the second washing unit 150 (S420).

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. A laundry processing device comprising:

a first washing unit for performing washing; and a second washing unit having a washing space independent from the first washing unit and provided with a tub of a smaller capacity than the first washing unit, wherein the first washing unit comprises:

a first display unit;

a first laundry amount detecting unit for measuring an amount of laundry in the first washing unit; and a first control unit is configured to display, on the first display unit, a guide message recommending use of the second washing unit, if the amount of laundry measured by the first laundry amount detecting unit is equal to or less than a first set value.

2. The laundry processing device of claim 1, wherein the first laundry amount detecting unit measures the amount of laundry in the first washing unit by using a weight sensor provided in the first washing unit, or by detecting a current generated when a motor of the first washing unit is rotated.

3. The laundry processing device of claim 1, wherein the first washing unit further comprises a first input comprising:

a washing unit selection key for receiving a second washing unit use command or a first washing unit use command in response to the guide message; and a washing start key for receiving a washing start command of the first washing unit, wherein, after the guide message is displayed, the first control unit is configured to enable the first washing unit to perform washing, if the washing unit selection key is not inputted during a set time, the first washing unit use command is inputted through the washing unit selection key, or the washing start command of the first washing unit is inputted through the washing start key.

4. The laundry processing device of claim 1, wherein the first washing unit further comprises a first input unit which is provided with a washing start key to which a washing start command of the first washing unit is inputted, wherein the first control unit is configured to control the first laundry amount detecting unit to measure the amount of laundry in the first washing unit, when the washing start command is inputted through the washing start key.

5. The laundry processing device of claim 1, wherein the first washing unit further comprises a first communication unit for performing communication with the second washing unit, wherein the first control unit is configured to control the first communication unit to transmit information on at least one of the measured laundry amount of the first washing unit, previously inputted washing course, or operation setting to the second washing unit, if the measured laundry amount is equal to or less than the first set value.

6. The laundry processing device of claim 5, wherein the first washing unit further comprises a first door and a first door sensor for detecting opening of the first door, wherein the first control unit is configured to control the first communication unit to transmit the information on at least one of the measured laundry amount of the first washing unit, the previously inputted washing course, or operation setting to the second washing unit, when opening of the first door is detected through the first door sensor.

7. The laundry processing device of claim 1, wherein the second washing unit comprises:

a second communication unit for performing communication with the first washing unit; and a second control unit is configured to set a washing course of the second washing unit based on received information, when information on at least one of the laundry amount, the previously inputted washing course, or operation setting is received from the first washing unit through the second communication unit.

8. The laundry processing device of claim 1, wherein the first washing unit further comprises a power consumption calculation unit for calculating an estimated power consumption of each of the first washing unit and the second washing unit based on the measured laundry amount, and calculating an estimated power consumption difference between the first washing unit and the second washing unit, wherein the first control unit is configured to enable the first display unit to display the estimated power consumption difference between the first washing unit and the second washing unit calculated by the power consumption calculation unit.

9. The laundry processing device of claim 1, wherein the second washing unit comprises:

a second display unit;

a second laundry amount detecting unit for measuring an amount of laundry in the second washing unit; and a second control unit is configured to display, on the second display unit, a guide message recommending use of the first washing unit having a tub having a capacity larger than that of the second washing unit if the amount of laundry measured by the second laundry amount detecting unit is equal to or greater than a second set value.

10. The laundry processing device of claim 9, further comprising a second input unit which is provided with a washing start key to which a washing start command of the second washing unit is inputted, wherein the second control unit is configured to control the second laundry amount detecting unit to measure the amount of laundry in the second washing unit, when the washing start command is inputted through the washing start key.

11. The laundry processing device of claim 9, wherein the second washing unit further comprises a second communication unit for performing communication with the first washing unit, wherein the second control unit is configured to control the second communication unit to transmit information on at least one of the measured laundry amount of the second washing unit, previously inputted washing course, or operation setting to the first washing unit, if the measured laundry amount is equal to or greater than the second set value.

12. The laundry processing device of claim 1, further comprising a wireless communication unit for performing wireless communication with a preset mobile terminal, wherein the first control unit is configured to enable the wireless communication unit to transmit the guide message to the preset mobile terminal.

13. The laundry processing device of claim 12, wherein the guide message includes an input window for selecting whether to use the second washing unit or the first washing unit.

14. A method for controlling a laundry processing device comprising a first washing unit and a second washing unit that have a washing space independently of each other, the method comprising:

an input step of receiving an input of a washing start command;

a measuring step of measuring, via a laundry amount sensor, an amount of laundry in the first washing unit, in response to the washing start command;

a comparison step of comparing the measured laundry amount with a first set value; and a guiding step of displaying a guide message recommending use of the second washing unit, which has a tub of a smaller capacity than the first washing unit on a first display unit provided in the first washing unit, if the amount of laundry is equal to or less than the first set value.

15. The method of claim 14, further comprising:

receiving a second washing unit use command or a first washing unit use command in response to the guide message; and performing washing by using the first washing unit, when the second washing unit use command is not inputted within a set time after the guide message is displayed, or when the first washing unit use command is inputted.

16. The method of claim 14, further comprising:

transmitting information on at least one of the measured laundry amount of the first washing unit, washing course or operation setting previously inputted to the first washing unit to the second washing unit, when a second washing unit use command is inputted in response to the guide message; and setting a washing course of the second washing unit based on the received information, when the information on at least one of the measured laundry amount of the first washing unit, the washing course or operation setting previously inputted to the first washing unit is received by the second washing unit.

17. The method of claim 14, further comprising:

calculating an estimated power consumption of each of the first washing unit and the second washing unit based on a set washing time corresponding to the measured laundry amount, calculating an estimated power consumption difference between the first washing unit and the second washing unit, and displaying the estimated power consumption difference on the first display unit along with the guide message.

18. A method for controlling a laundry processing device comprising a first washing unit and a second washing unit that have a washing space independently of each other, the method comprising:

receiving an input of a washing start command;

measuring, via a laundry amount sensor, an amount of laundry in the second washing unit, in response to the washing start command;

comparing the measured laundry amount with a second set value; and displaying a guide message recommending use of the first washing unit, which has a tub of a larger capacity than the second washing unit, or displaying a message warning that washing is impossible on a second display unit provided in the second washing unit, if the amount of laundry is equal to or greater than the second set value.

19. The method of claim 18, further comprising:

transmitting information on at least one of the measured laundry amount of the second washing unit, previously inputted washing course, or operation setting to the first washing unit, when a first washing unit use command is inputted in response to the guide message; and setting a washing course of the first washing unit based on the received information, when the information on at least one of the measured laundry amount of the second washing unit, the previously inputted washing course or operation setting is received by the first washing unit.

20. The method of claim 18, further comprising:

performing washing by using the second washing unit, when the first washing unit use command is not inputted for a set time after the guide message is displayed, or when the second washing unit use command is inputted.

* * * * *